United States Patent [19]

Lee et al.

[11] 4,147,363

[45] Apr. 3, 1979

[54] MULTI-GAME DECK OF TILES

[76] Inventors: Sang C. Lee; Minja P. Lee, both of 68 Wendt La., Wayne Township, Passaic County, N.J. 07470

[21] Appl. No.: 837,004

[22] Filed: Sep. 27, 1977

[51] Int. Cl.[2] ..... A63F 1/00

[52] U.S. Cl. ..... 273/304; 273/306

[58] Field of Search ..... 273/292, 303, 304, 305, 273/306

[56] References Cited

U.S. PATENT DOCUMENTS

| | | | |
|---|---|---|---|
| D. 132,701 | 6/1942 | McHanus | 273/306 X |
| 1,554,834 | 9/1925 | Babcock | 273/306 |
| 1,559,813 | 11/1925 | Van Beuthuysen | 273/306 |
| 1,581,859 | 4/1926 | New | 273/306 |
| 1,677,010 | 7/1928 | Zimmerman | 273/306 |

*Primary Examiner*—Anton O. Oechsle

[57] ABSTRACT

There are 168 tiles comprised of 10 tiles each for 12 months, January through December, 10 tiles each for 4 seasons, spring through winter, 8 tiles for Jokers. Tiles are so structured and designed that it is possible to play many different kind of games. For example, tiles can be used to play a new game, Metropolee, whose rules resemble that of Mah-Jongg, any western card games such as bridge and black jack, and any traditional Japanese card games.

1 Claim, 169 Drawing Figures

MULTI-GAME DECK OF TILES

BRIEF SUMMARY OF THE INVENTION

The tiles can be made of Plexiglas, or plastics, or wood, or ivory. Four seasons, the structure of Metropolee, are symbolized by four design elements, Azalea flowers for spring, sunflowers for summer, maple leaves for fall, and holly leaves and berries for winter. Season tiles are distinguished by 4 additional design elements, heart for spring, clover leaf for summer, spade for fall, and diamond for winter. Months are also inscribed on month-tiles, January through December. Month-tiles of each season having a value of 10 are marked with J for Jack (1st month, K for King (2nd month), Q for Queen (3rd month). In addition, these tiles having a value of 10 are inscribed with heart, or clover, or spade, or diamond, symbolizing the seasons they belong. This design permits players to play a wide range of games, Metropolee, any western card games, and any traditional Japanese card games.

BRIEF DESCRIPTION OF THE SEVERAL VIEWS OF THE DRAWING

FIGS. 2–11 — Spring season tiles (A-10)
FIGS. 166–169 — Joker tiles (B)

Western card game set

Figure 1:
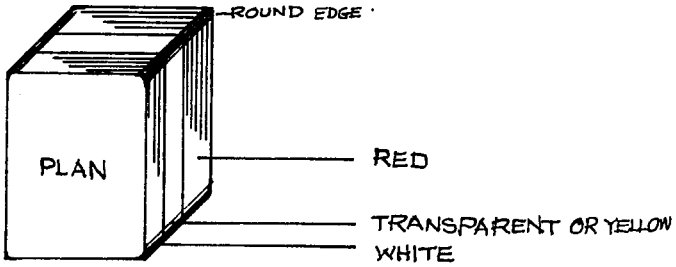
FIG. 1 — Describes the dimension of tiles and color scheme. The tiles are made of Plexiglas, or plastics, or wood or ivory.
Figure 2:
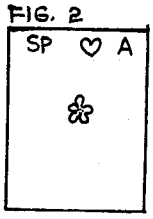
FIGS. 2–168 — These are plan views of the tile. Color schemes are also indicated.
Figure 3:
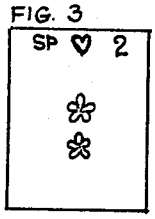
Figure 4:
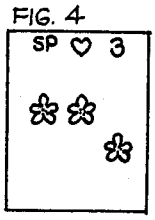
Figure 5:
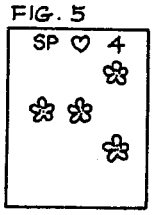
Figure 6:
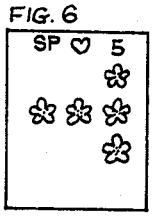
Figure 7:
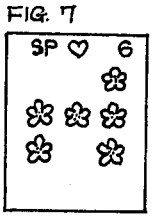
Figure 8:
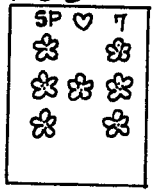
Figure 9:
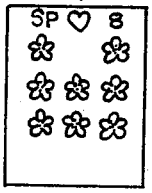
Figure 10:
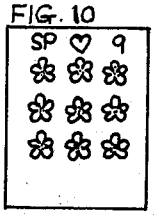
Figure 11:
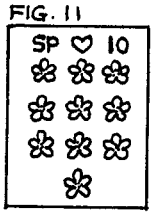
Figure 12:
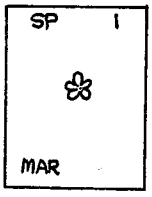
FIGS. 12–21 — Spring season, March tiles (1-J)
Figure 13:
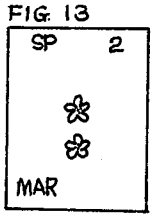
Figure 14:
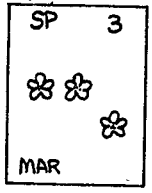
Figure 15:
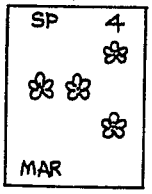
Figure 16:
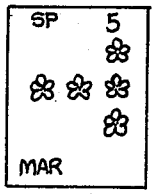
Figure 17:
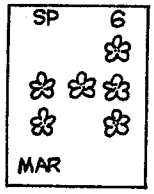
Figure 18:
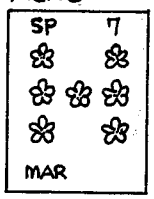
Figure 19:
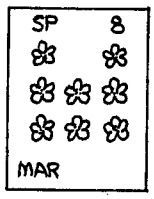
Figure 20:
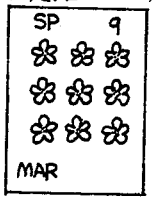
Figure 21:
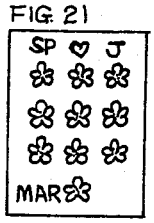
Figure 22:
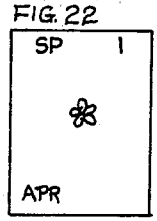
FIGS. 22–31 — Spring season, April tiles (1-K)
Figure 23:
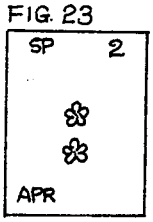
Figure 24:
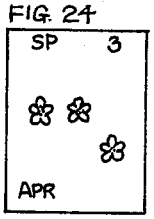
Figure 25:
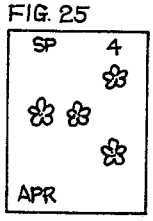
Figure 26:
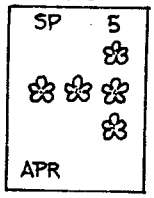
Figure 27:
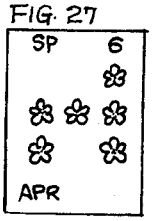
Figure 28:
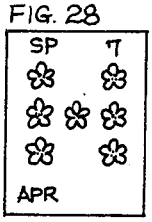
Figure 29:
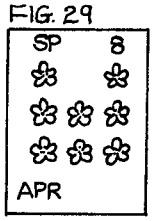
Figure 30:
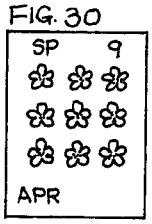
Figure 31:
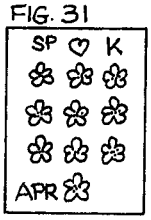
Figure 32:
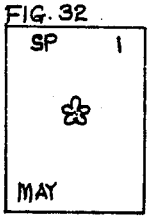
FIGS. 32–41 — Spring season, May tiles (1-Q)
Figure 33:
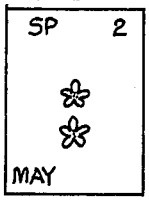
Figure 34:
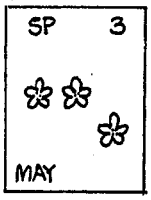
Figure 35:
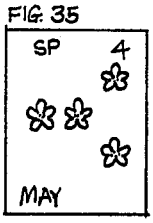
Figure 36:
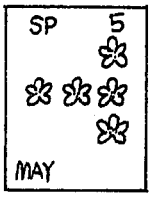
Figure 37:
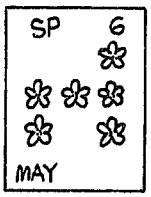
Figure 38:
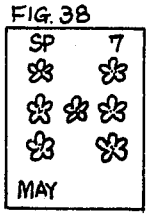
Figure 39:
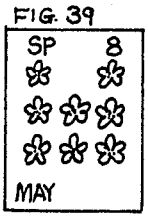
Figure 40:
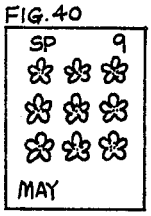
Figure 41:
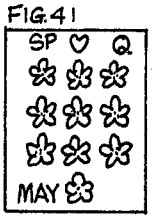
Figure 42:
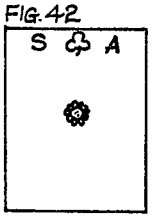
FIGS. 42–51 — Summer season tiles (A-10)
Figure 43:
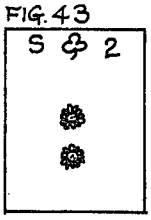
Figure 44:
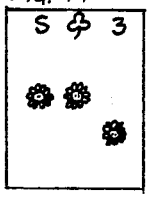
Figure 45:
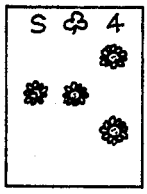
Figure 46:
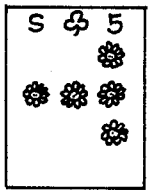
Figure 47:
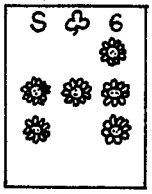
Figure 48:
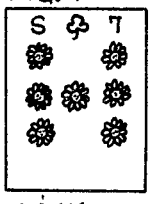
Figure 49:
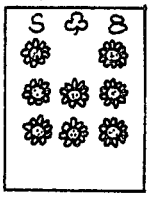
Figure 50:
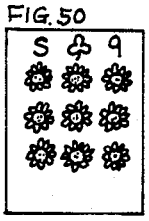
Figure 51:
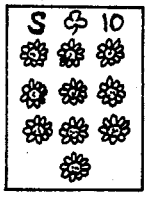
Figure 52:
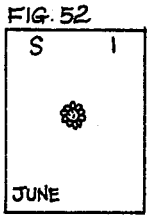
FIGS. 52–61 — Summer season, June tiles (1-J)
Figure 53:
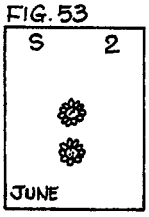
Figure 54:
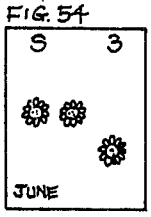
Figure 55:
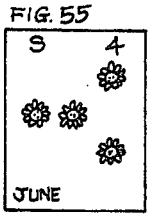
Figure 56:
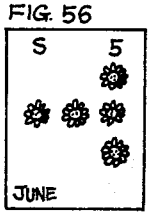
Figure 57:
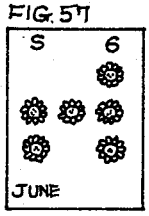
Figure 58:
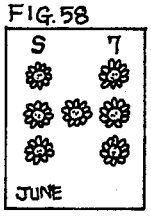
Figure 59:
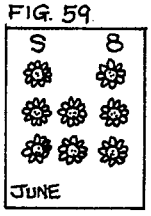
Figure 60:
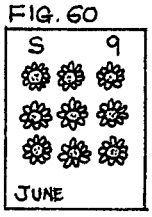

FIGS. 2–11. Heart, A-10. FIG. 21 Heart J. FIG. 31 Heart K. FIG. 41 Heart, Q.

Figure 61:
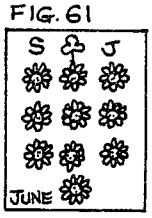
Figure 62:
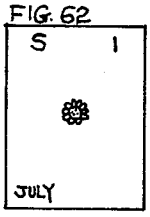
FIGS. 62–71 — Summer season, July tiles (1-K)
Figure 63:
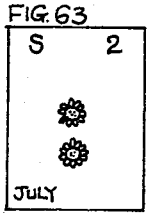
Figure 64:
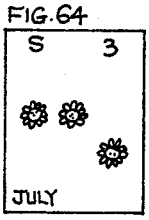
Figure 65:
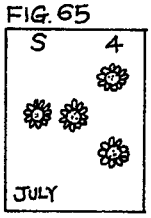
Figure 66:
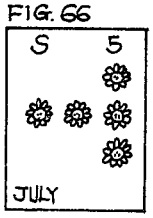
Figure 67:
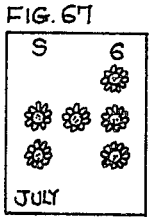
Figure 68:
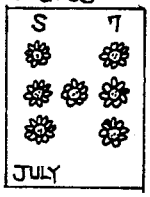
Figure 69:
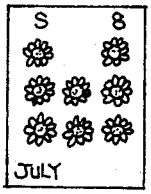
Figure 70:
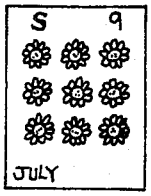
Figure 71:
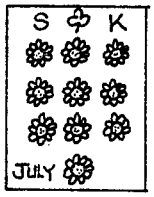
Figure 72:
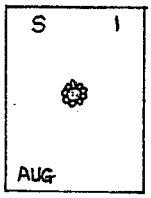
FIGS. 72–81 — Summer season, August tiles (1-Q)
Figure 73:
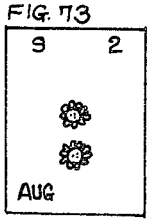
Figure 74:
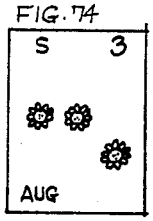
Figure 75:
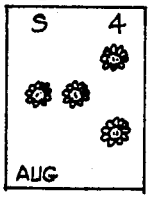
Figure 76:
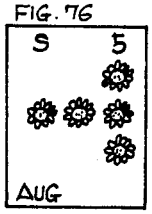
Figure 77:
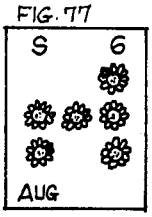
Figure 78:
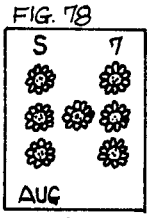
Figure 79:
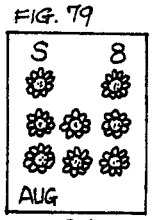
Figure 80:
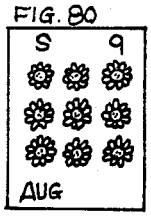
Figure 81:
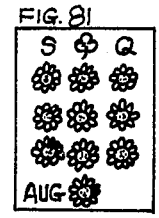
Figure 82:
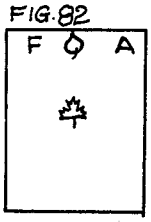
FIGS. 82–91 — Fall season tiles (A-10)
Figure 83:
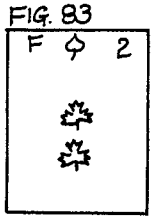
Figure 84:
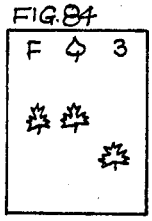
Figure 85:
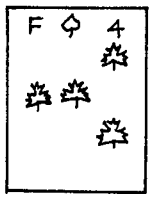
Figure 86:
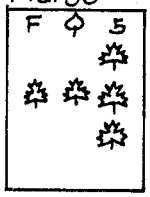
Figure 87:
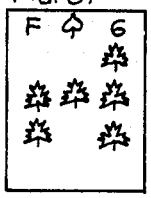
Figure 88:
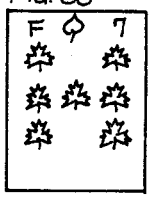
Figure 89:
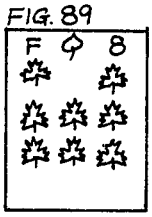
Figure 90:
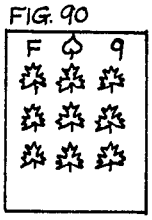
Figure 91:
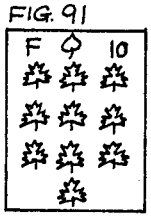
Figure 92:
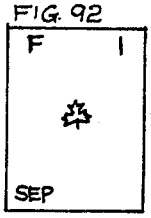
FIGS. 92–101 — Fall season, September tiles (I-J)
Figure 93:
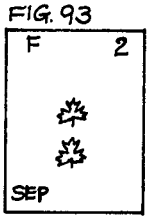
Figure 94:
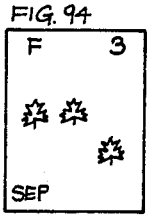
Figure 95:
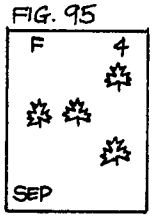
Figure 96:
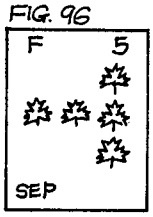
Figure 97:
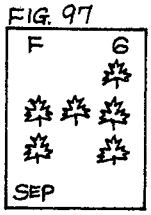
Figure 98:
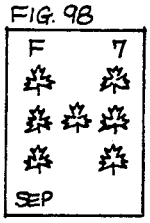
Figure 99:
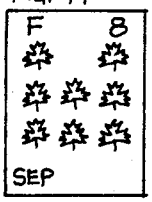
Figure 100:
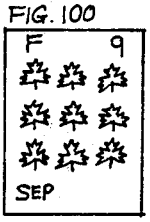

FIGS. 42–51. Clover, A-10. FIG. 61 Clover J. FIG. 71 Clover K. FIG. 81 Clover Q.

Figure 101:
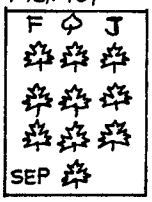
Figure 102:
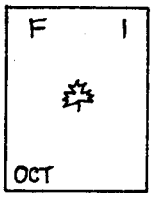
FIGS. 102–111 — Fall season, October tiles (1-K)
Figure 103:
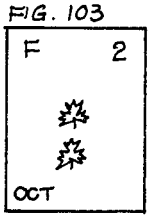
Figure 104:
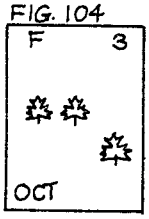
Figure 105:
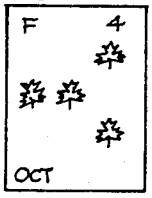
Figure 106:
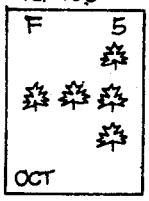
Figure 107:
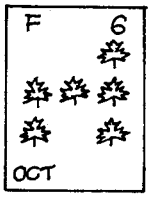
Figure 108:
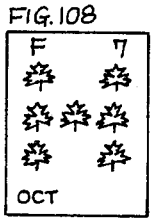
Figure 109:
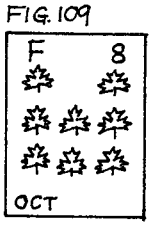
Figure 110:
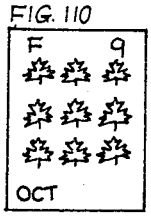
Figure 111:
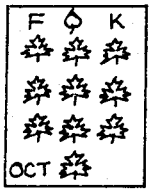
Figure 112:
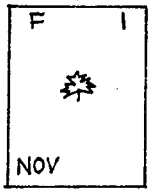
FIGS. 112–121 — Fall season, November tiles (1-Q)
Figure 113:
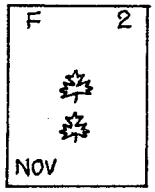
Figure 114:
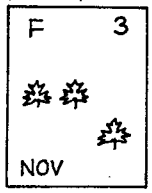
Figure 115:
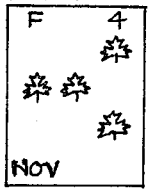
Figure 116:
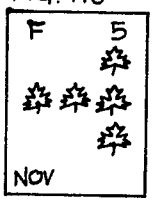
Figure 117:
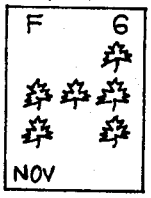
Figure 118:
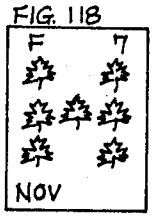
Figure 119:
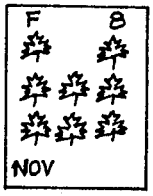
Figure 120:
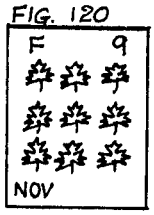
Figure 121:
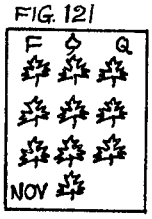
Figure 122:
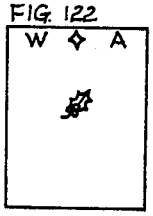
FIGS. 122–131 — Winter season tiles (A-10)
Figure 123:
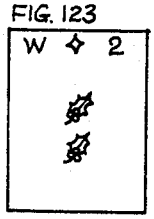
Figure 124:
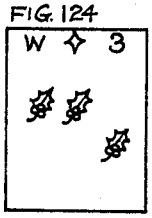
Figure 125:
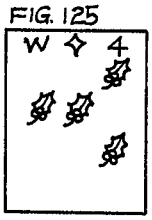
Figure 126:
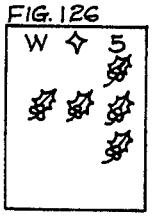
Figure 127:
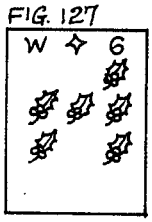
Figure 128:
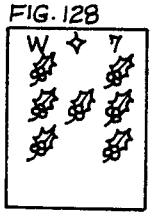
Figure 129:
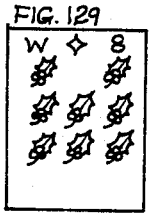
Figure 130:
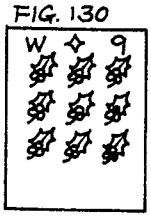
Figure 131:
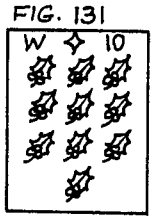
Figure 132:
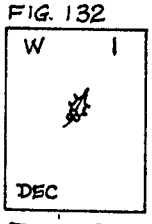
FIGS. 132–141 — Winter season, December tiles (1-J)
Figure 133:
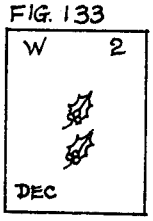
Figure 134:
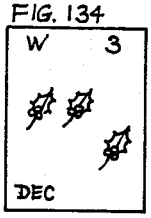
Figure 135:
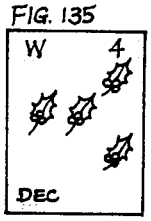
Figure 136:
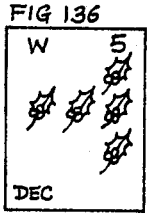
Figure 137:
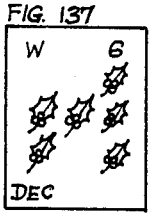
Figure 138:
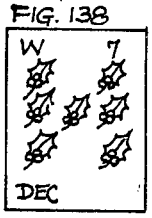
Figure 139:
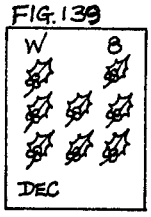
Figure 140:
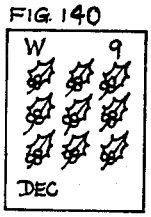

FIGS. 82–91. Spade A-10. FIG. 101 Spade J. FIG. 111 Spade K. FIG. 121 Spade Q.

Figure 141:
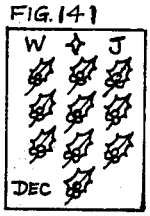
Figure 142:
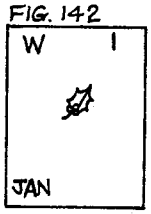
FIGS. 142–151 — Winter season, January tiles (1-K)
Figure 143:
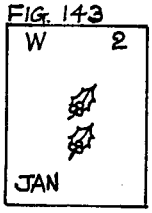
Figure 144:
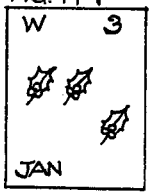
Figure 145:
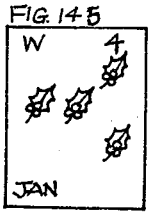
Figure 146:
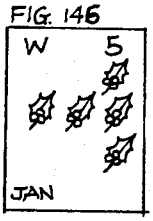
Figure 147:
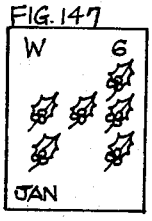
Figure 148:
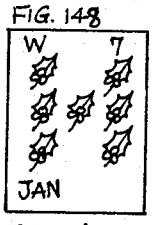
Figure 149:
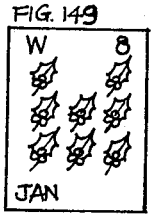
Figure 150:
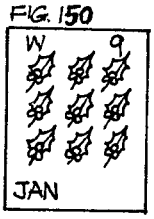
Figure 151:
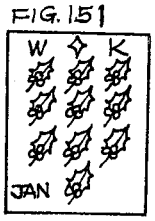
Figure 152:
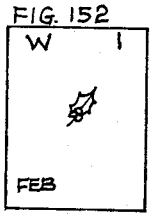
FIGS 152–161 — Winter season, February tiles (1-Q)
Figure 153:
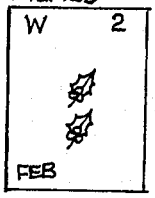
Figure 154:
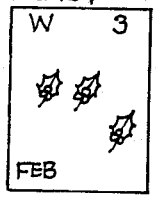
Figure 155:
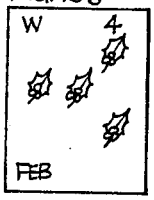
Figure 156:
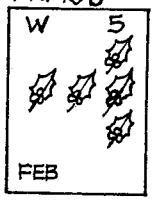
Figure 157:
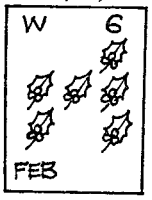
Figure 158:
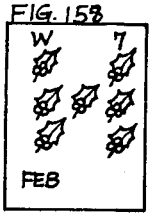
Figure 159:
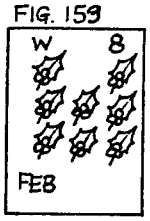
Figure 160:
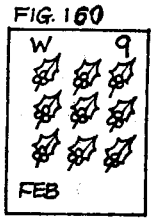
Figure 161:
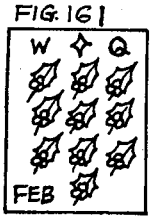
Figure 162:
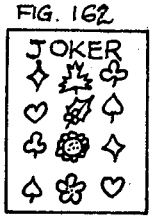
FIGS. 162–165 — Joker tiles (A)
Figure 163:
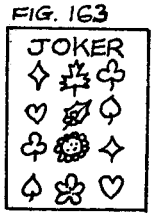
Figure 164:
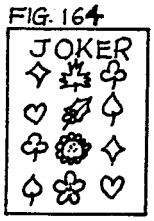
Figure 165:
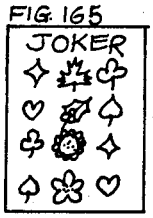
Figure 166:
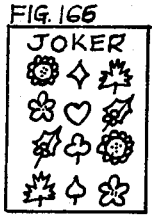
Figure 167:
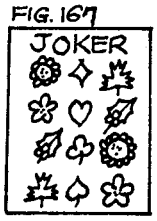
Figure 168:
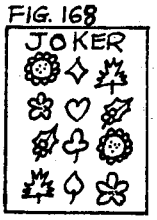
Figure 169:
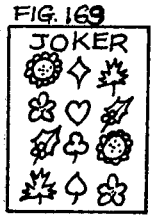

FIG. 122–131. Diamond, A-10. FIG. 141 Diamond J. FIG. 151 Diamond K. FIG. 161 Diamond Q.

FIGS. 162–169. Jokers.

Japanese card game set: ( ) i.e. Japanese card value.

| | | | | | |
|---|---|---|---|---|---|
| January | Figs. | 142 (0) | 143 (0) | 146 (5) | 151 (20) |
| February | Figs. | 152 (0) | 153 (0) | 156 (5) | 160 (10) |
| March | Figs. | 12 (0) | 16 (5) | 20 (10) | 21 (20) |
| April | Figs. | 22 (0) | 23 (0) | 26 (5) | 30 (10) |
| May | Figs. | 32 (0) | 33 (0) | 36 (5) | 40 (10) |
| June | Figs. | 52 (0) | 53 (0) | 56 (5) | 60 (10) |
| July | Figs. | 62 (0) | 63 (0) | 66 (5) | 70 (10) |

-continued

Japanese card game set: ( ) i.e. Japanese card value.

| | | | | | |
|---|---|---|---|---|---|
| August | Figs. | 72 (0) | 73 (0) | 80 (10) | 81 (20) |
| September | Figs. | 92 (0) | 93 (0) | 96 (5) | 101 (10) |
| October | Figs. | 102 (0) | 103 (0) | 106 (5) | 110 (10) |
| November | Figs. | 112 (0) | 116 (5) | 120 (10) | 121 (20) |
| December | Figs. | 132 (0) | 133 (0) | 134 (0) | 141 (20) |

Note:
1, 2, 3 represent Zero value.
5 represents value 5.
9 represents value 10.
10 represents value 20.

DETAILED DESCRIPTION

How to play:

Metropolee: (Also called Four Seasons)

The game can be played by 2 to 4 people. Walls are constructed by laying down tiles with their faces down, forming a square, in a group of 2 tiles. 4 rows contain each 40 tiles. (excluding Jokers). A dice is rolled to determine the dealer. A player with the largest number will become the dealer. Numbers obtained by rolling dice by players are added. Using this number, the dealer determines the spot to start play, by counting from the right to the left. 28 tiles (14 pairs) counting from the end of the wall are set aside as reserve wall. Tiles from the reserve wall are used only when a player makes a quadruple combination.

Each player is given 13 tiles, 2 tiles at a time for 6 times, and 1 tile at the 7th distribution, starting from the player sitting immediately left to the dealer. Starting from the dealer, each player draws one tile at a time, clockwise, to form combinations of two, three, four tiles. Each combination must consist of the same season tiles. Combinations can be made with identical numbers (values) or consecutive numbers. A typical combination will consist of one pair and four triplets, a total of 14 tiles. Players will discard tiles they do not need and retain the tiles they need. Discarded tiles are lined up in front of each player with their faces up so that other players can see. A pair can be obtained only by drawing. Triplets and quadruplets can be made by drawing or by obtaining freshly discarded tiles by other players. Only the final tile of combinations can be obtained by the latter method. The final tile of consecutive number combinations can be obtained by declaring "snow" and only from the player sitting immediately to his right. The final tile of identical number combinations can be obtained by declaring "rain" and from any player, as tiles are discarded. When a player makes a quadruplet, he picks an additional tile from the reserve wall.

Combinations obtained by "snow" or "rain" must be disclosed to other players by laying down tiles with their faces up. When a player finishes combinations involving 14 tiles plus the fourth tiles of quadruplets, the player wins the game, by declaring "clear." When a player clears another player through his discarding, he alone pays double the total score. When a player clears by drawing, all players pay the score, giving the winner three times his points scored. A dealer pays and is paid double. The order of priority is: 1. Clear, 2. Rain, 3. Snow. When more than one player declare "clear" or "rain," player sitting closest to the discarding player has right to obtain the discarded tile. No player can claim tiles discarded previously.

Quadruplet combination tiles are always disclosed. If all 4 tiles are obtained through drawing (i.e. closed hand), two tiles, the first and fourth tiles are laid down with their faces down. If the first or last tile is obtained through snow or rain, only one closed hand is allowed and only one tile is laid down with its face down. If the second or third tile is obtained through snow or rain, no closed hand is allowed.

Dealership shifts to the next player when a dealer fails to win. When all players finish dealership, it constitutes a season. The game can be played one to four seasons, spring through winter.

Point system:

Combinations with consecutive numbers do not have any points except points accorded for closed hands. Each closed hand receives 10 points.

Triple: 3 tile-combination with identical numbers. 10 points. 10 points are given to a season tile and 20 points are given to a season tile with value "A."

Quadruple: 4 tile-combination with identical numbers. 30 points. 4 tiles with one "A" tile: 40 points.

Combinations with tiles of 10, J, K, Q:

2 tiles: 40 points. 3 tiles: 60 points.

4 tiles: 80 points.

7 pairs: This combination is achieved only through closed hands. 140 points.

All combinations with same season: Double the score. All combinations with identical numbers: Triple the score. 5000 point-chips are given to each player and a player with most points at the end of seasons wins the game.

As an option, there are 8 jokers in 2 sets of 4 tiles per set. These tiles may be used to purchase previously discarded tiles. This optional rule makes the game too easy and experienced players should avoid this rule. If this option is adopted, 4 raws of 42 tiles should be used to construct walls.

Western card game:

40 season tiles and month-tiles having values J, K, Q plus jokers are used to play any western card games.

Japanese card game:

48 tiles, 4 tiles from each month, are used to play any Japanese card games. Tiles of values, 1, 2, 3 have 0 point. Tiles of value 5 represent 5 points. Tiles of value 9 represent 10 points. Tiles of value 10 represent 20 points. Jan. 1, 2, 5, 10; Feb. 1, 2, 5, 9; Mar. 1, 5, 9, 10; April 1, 2, 5, 9; May 1, 2, 5, 9; June 1, 2, 5, 9; July 1, 2, 5, 9; August 1, 2, 9, 10; Sept. 1, 2, 5, 9; Oct. 1, 2, 5, 9; Nov. 1, 5, 9, 10; Dec. 1, 2, 3, 10 are used.

In addition, there are many other games involving 160 or 168 tiles. A few examples are:

Chase:

All tiles are equally distributed to players. A beginning player will request tiles from other players (e.g. Winter 6) until he commits the error of requesting unavailable tiles. Play is resumed by the next player clockwise. When a set of 2 tiles with identical numbers are collected, these tiles are layed down face up, which can not be claimed by other players. A pair receives 5 points. A quadruple receives 10 points. Triples do not receive any points and this combination can not happen.

Mystery:

One mystery tile is selected at random in the beginning. Its identity is hidden from all players. Then, tiles are distributed to all players. Each player taking turn draws one tile at a time from the player sitting to his right. Play proceeds clockwise. Whenever a player has a pair of identical value, these tiles are eliminated from play. Players who get rid of all his tiles sooner will be ranked higher. The player with an unmatched tile is the lowest ranking player.

Treasure hunt:

All tiles are laid down at random with their faces down. The beginning player selects a tile and turn its face up. Then, he proceeds to pick up the second tile. If two tiles are of identical season and value, the player keeps two tiles. Then, he repeats this process. When he fails to make pairs without interruption, next player takes over. Play is continued clockwise. Point systems are same as Chase.

We claim:

1. A deck of 168 tiles, said deck comprising: 120 tiles bearing month indicia with ten tiles thereof each representing the months of January through December; forty tiles bearing season indicia with ten tiles thereof each representing the seasons of spring, summer, autumn and winter; and eight tiles having joker indicia; fifty-two selected ones of said month and season indicia bearing tiles being additionally provided with club, diamond, heart and spade indicia and the rankings ace through king to constitute a conventional bridge deck; said indicia thereby enabling said deck or portions of said deck to be selectively used to play a wide variety of card games including any traditional western card game and any traditional Japanese card game.

* * * * *